US007748861B2

(12) United States Patent
Byrne et al.

(10) Patent No.: US 7,748,861 B2
(45) Date of Patent: Jul. 6, 2010

(54) LIGHT WITH HEATER

(75) Inventors: Brendan Patrick Byrne, Germantown, TN (US); Edwin T. Koehler, Cordova, TN (US)

(73) Assignee: Hunter Fan Company, Memphis, TN (US)

( * ) Notice: Subject to any disclaimer, the term of this patent is extended or adjusted under 35 U.S.C. 154(b) by 11 days.

(21) Appl. No.: 11/602,925

(22) Filed: Nov. 21, 2006

(65) Prior Publication Data

US 2008/0117636 A1 May 22, 2008

(51) Int. Cl.

| | |
|---|---|
| ***F21V 33/00*** | (2006.01) |
| ***F21V 21/14*** | (2006.01) |
| ***F21S 8/00*** | (2006.01) |
| ***F26B 3/30*** | (2006.01) |
| ***H05B 1/00*** | (2006.01) |
| ***F24F 7/00*** | (2006.01) |

(52) U.S. Cl. ..... 362/92; 362/149; 362/363; 392/393; 392/411; 219/220; 454/293

(58) Field of Classification Search ..... 362/92, 362/393, 149, 363, 147, 404; 219/220; 454/293–295; 392/393, 411–415

See application file for complete search history.

(56) References Cited

U.S. PATENT DOCUMENTS

| | | | | | |
|---|---|---|---|---|---|
| 2,010,322 | A | | 8/1935 | Riddell | 454/293 |
| 2,689,906 | A | | 9/1954 | Corbett | 392/347 |
| 3,001,056 | A | * | 9/1961 | Spear | 392/347 |
| 3,025,379 | A | | 3/1962 | Ford | 219/220 |
| 3,028,475 | A | * | 4/1962 | Nash | 219/201 |
| 3,068,341 | A | * | 12/1962 | Ortiz et al. | 219/220 |
| 3,141,086 | A | | 7/1964 | Prager | 219/220 |
| 4,342,073 | A | * | 7/1982 | Ranten | 362/294 |
| 4,520,435 | A | * | 5/1985 | Baldwin | 362/311 |
| 4,681,024 | A | * | 7/1987 | Ivey | 454/233 |
| 4,711,161 | A | * | 12/1987 | Swin et al. | 454/230 |
| 4,748,900 | A | * | 6/1988 | Swin et al. | 454/295 |
| 5,077,825 | A | | 12/1991 | Monrose | 392/361 |
| 5,333,235 | A | | 7/1994 | Ryder | 392/364 |
| 5,425,126 | A | | 6/1995 | Lee | 392/364 |
| 5,567,041 | A | * | 10/1996 | Slocum | 362/148 |
| D381,074 | S | | 7/1997 | Pelonis | D23/336 |
| 5,668,920 | A | * | 9/1997 | Pelonis | 392/361 |
| D404,123 | S | | 1/1999 | Pelonis | D23/336 |
| D435,094 | S | | 12/2000 | Bucher | D23/336 |
| 6,240,247 | B1 | | 5/2001 | Reiker | 392/364 |
| 6,438,322 | B1 | | 8/2002 | Reiker | 392/364 |
| 6,474,846 | B1 | * | 11/2002 | Kelmelis et al. | 362/365 |
| 6,477,321 | B2 | | 11/2002 | Reiker | 392/364 |

(Continued)

*Primary Examiner*—Jacob Y Choi
*Assistant Examiner*—David J Makiya
(74) *Attorney, Agent, or Firm*—Baker Donelson

(57) ABSTRACT

A light fixture (10) is provided having a housing (11), a light diffusor (12), a light source (13), and a heating source (14). The housing includes a mounting plate (17) adapted to be mounted to the ceiling of a structure in conventional fashion. The mounting plate includes a radial array of mounting arms (18) which form air intake openings (19) therebetween. The mounting plate is coupled to a tubular flow channel (21) having a central passage (22) extending therethrough. The bottommost portion of the flow channel includes threaded neck (24). A threaded locking plate (28) rotatably mates with the threaded neck. The locking plate includes a radial array of exhaust openings (32) extending therethrough. The heat source includes a heating element (38) and a motorized fan (39).

22 Claims, 2 Drawing Sheets

U.S. PATENT DOCUMENTS 6,511,211 B1 * 1/2003 Karambelas ..... 362/311.01
6,587,642 B1 * 7/2003 King ..... 392/364
6,631,243 B2 * 10/2003 Reiker ..... 392/364
6,751,406 B2 * 6/2004 Reiker ..... 392/364
6,979,107 B1 * 12/2005 Benensohn ..... 362/374
2002/0064380 A1 5/2002 Reiker ..... 392/364
2004/0095752 A1 * 5/2004 Hsu ..... 362/147
2006/0092628 A1 * 5/2006 Pearce et al. ..... 362/147

* cited by examiner

LIGHT WITH HEATER

TECHNICAL FIELD

This invention relates generally to light fixtures, and more particularly to light fixtures having heating capabilities.

BACKGROUND OF THE INVENTION

Lighting fixtures have existed for many years. Recently, some lighting fixtures have incorporated heaters to warm the surrounding air. These light fixtures are typically placed in a bathroom so as to heat the room in order to make it more comfortable for people after taking a shower or bath. As such, these light fixtures are not designed to blend into the more formal aesthetics of other rooms within a typical home.

Accordingly, it is seen that a need remains for a light fixture that can provide heat but which is unobtrusive and easy to maintain. It is to the provision of such therefore that the present invention is primarily directed.

SUMMARY OF THE INVENTION

In a preferred form of the invention, a light fixture comprises a tubular housing having an air inlet, an air channel therethrough and a threaded end distal the air inlet. The light fixture also has a light diffusor having a central opening therein configured to receive the housing threaded end, a light source, a heat source to heat air passing through the housing air channel, and a locking plate threadably coupled to the housing threaded end. The locking plate has at least one exhaust opening. With this construction, an airstream passing through the housing is heated by the heat source and expelled from the exhaust opening within the locking plate.

DETAILED DESCRIPTION

Figure 1:
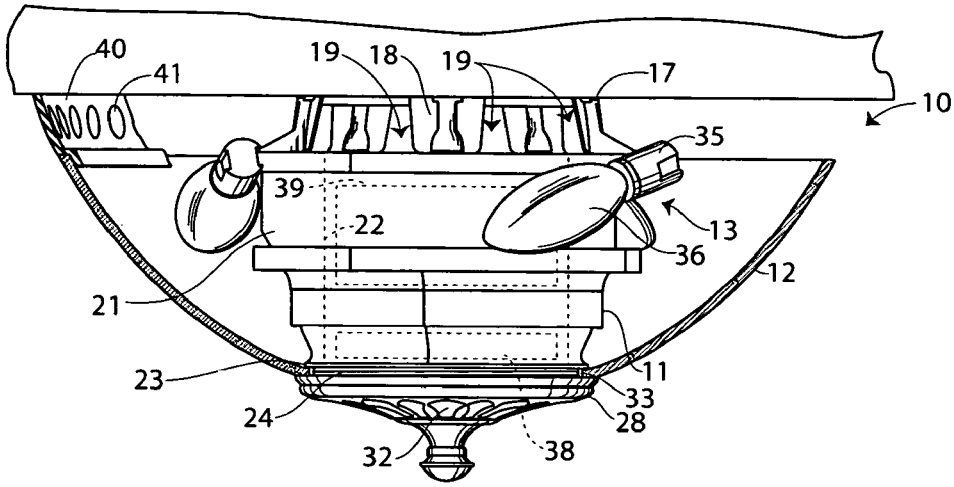
FIG. 1 is a side view of a light fixture of the present invention.
Figure 2:
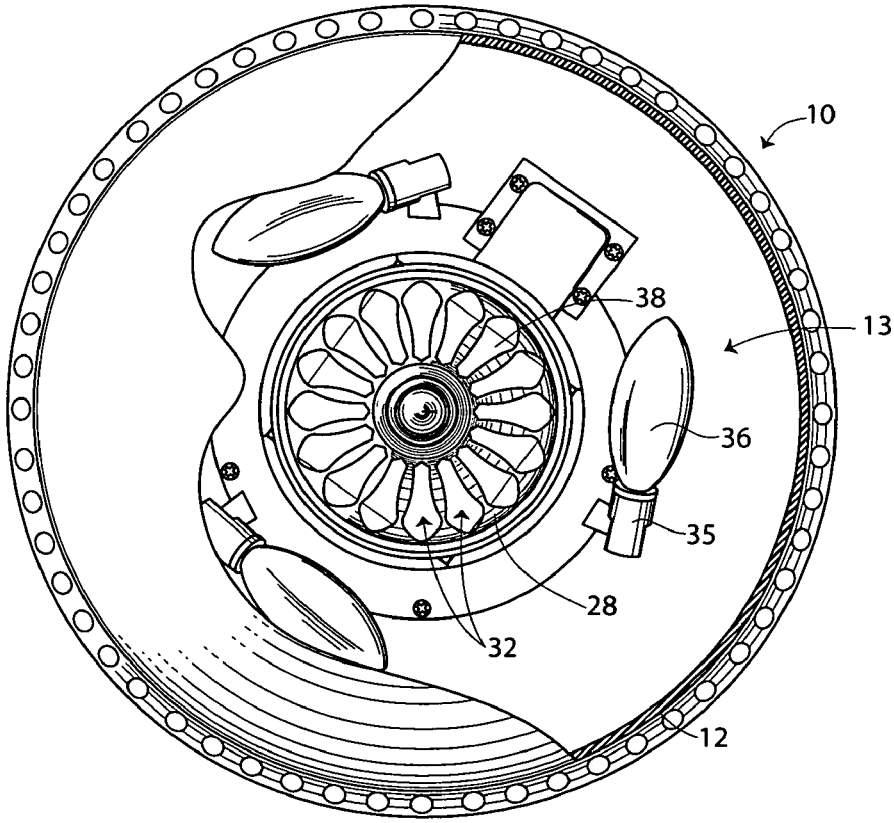
FIG. 2 is a bottom view of the light fixture of FIG. 1.
Figure 3:
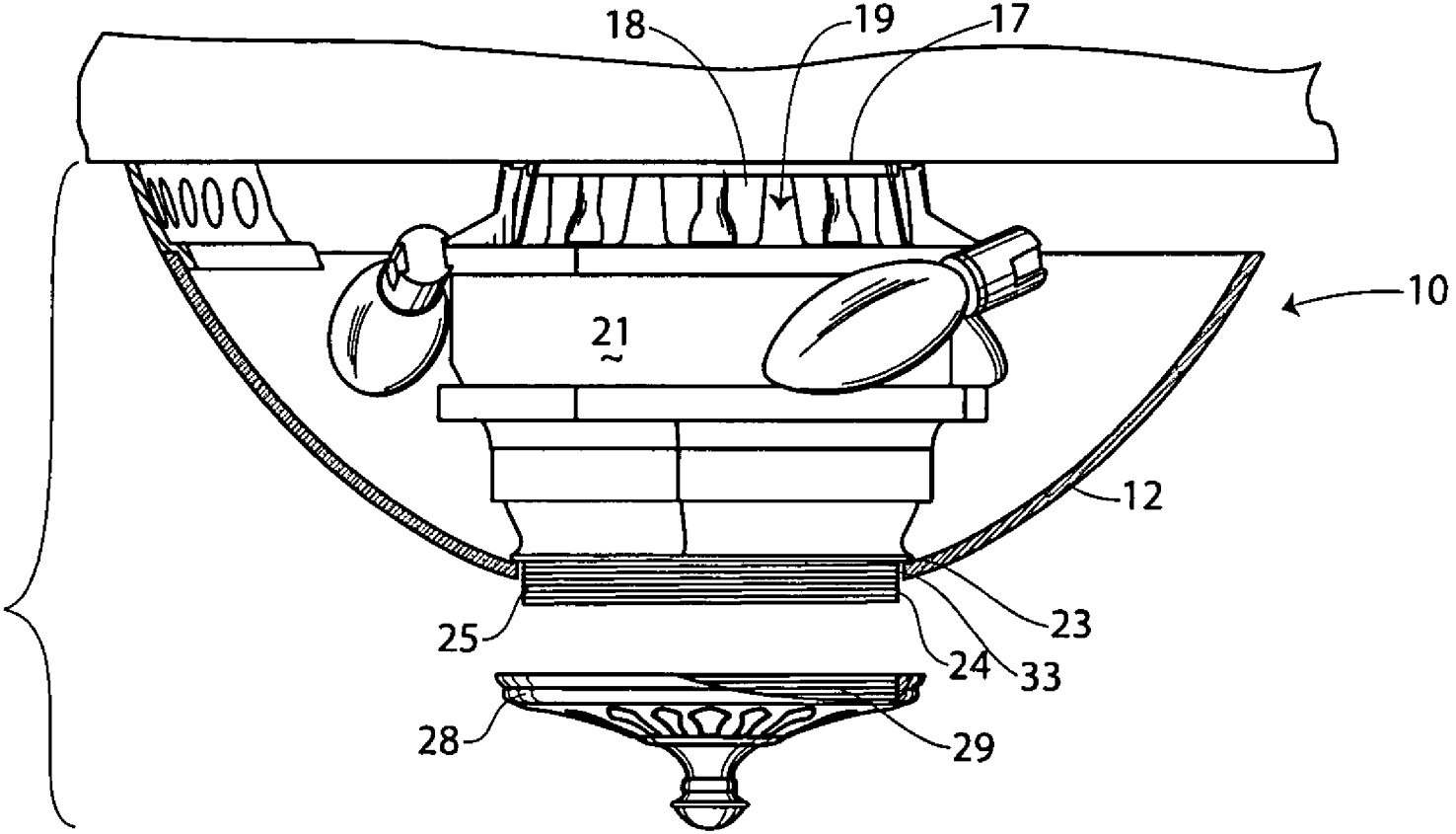
FIG. 3 is a partially exploded view of the light fixture of FIG. 1.

With reference next to the drawings, there is shown a light fixture 10 in a preferred form of the invention. The light fixture 10 includes a housing 11, a translucent shade or light diffusor 12, a light source 13, and a heating source 14.

The housing 11 includes a mounting plate 17 adapted to be mounted to the ceiling or junction box of a structure in conventional fashion. The mounting plate 17 includes a radial array of mounting arms 18 which form air intake spaces or openings 19 therebetween. The mounting plate 17 is coupled to a tubular flow channel 21 having a central passage 22 extending therethrough. The bottommost portion of the flow channel 21 is annular and includes an upper diffusor seat 23 and a neck 24 with external threads 25. A locking plate or finial plate 28 having internal threads 29 rotatably mates with the threaded neck 24. The locking plate 28 includes a radial array of exhaust openings 32 extending therethrough.

The light diffusor 12 may be made of any transparent or translucent material, such as glass or plastic. The light diffusor 12 has a central opening 33 therein configured to receive the neck 24 of the housing and abut the diffusor seat 23. The threading of the locking plate 28 upon the neck 24 maintains the position of the light diffusor 12 upon the housing 11.

The light source 13 includes a series of light sockets 35 mounted to the housing 11. The light sockets 25 are electrically coupled to electrical wires which are coupleable to the electric wires within a home in conventional fashion. A light bulb 36 is mounted within each light socket 35.

The heat source 14 includes a heating element 38 mounted within the central passage 22 of the housing flow channel 21. The heating element 38 may be a positive temperature coefficient heater (PTC heater). The heat source 14 also includes a motorized fan 39 which creates an air flow, as indicated by the arrows in the drawings, which enters the housing through the mounting plate spaces 19, flows through the central passage 22, through the heating element 38, and exits through the locking plate exhaust openings 32. The heating element 38 and motorized fan 39 are also coupled to the home wiring in conventional fashion.

In use, the light fixture may be used as a light, as a heater, or as both a light and a heater. The light source and/or heat source may be supplied with an electric current through the electrical wires through any conventional switch, such as a wall switch, a switch mounted to the device itself such as a pull cord switch, or a remote controlled switch such as an RF control circuit. During use as a heater or as a light and heater, the fan 39 creates and airstream that is heated by the heating element 38 and is expelled from the housing 11 through the locking plate openings 32.

The removability of the locking plate allows for easy maintenance of the heating element or the efficient removal of the light diffusor for cleaning or the changing of light bulbs. The exhaust openings within the locking plate allow the heated air to be directed downwardly to efficiently heat a room, rather than being directed upwardly towards the ceiling.

As an option, the light diffusor may includes a trim ring 40 which extends to a position closely adjacent the overlying ceiling. The trim ring would include air inlets 41 to allow airflow into the space within the light diffusor.

It should be understood that the light fixture of the present invention may includes light fixtures coupled to ceiling fans, rather than directly to the ceiling or wall of a structure. It should also be understood that as an alternative, the housing may have internal threads while the locking plate has corresponding external threads or threaded mounting rod and rod receiver. The light diffusor may also be mounted directly to the locking plate. Lastly, it should be understood that the positioning of the heater is not critical, as it may be positioned closer to the top of the housing, in the middle of the housing, or closer to the bottom of the housing.

It thus is seen that a light fixture is now provided which provides heat but which is unobtrusive. While this invention has been described in detail with particular reference to the preferred embodiment thereof, it should be understood that many modification, additions and deletions, may be made thereto without departure from the spirit and scope of the invention as set forth in the following claims.

The invention claimed is:

1. A light fixture comprising, a tubular housing having an air inlet and an air channel therethrough, said housing also having a threaded end distal said air inlet defined by a peripherally threaded, annular neck through which said air channel extending;

a light diffusor having a central opening therein configured to receive said housing threaded end;

a light source coupled to said housing;

a heat source coupled to said housing to heat air passing through said housing air channel, and a locking plate threadably coupled to said neck of said housing threaded end, said locking plate having at least one exhaust opening, whereby an airstream passing through the housing is heated by the heat source and expelled from the exhaust opening within the locking plate.

2. The light fixture of claim 1 wherein said locking plate includes an annular array of exhaust openings.

3. The light fixture of claim 1 wherein said heat source is a positive temperature coefficient heater.

4. The light fixture of claim 1 wherein said housing includes a mounting plate having an annular array of air intake openings therein.

5. The light fixture of claim 1 wherein said housing threaded end has external threads.

6. The light fixture of claim 1 further comprising a fan coupled to said housing.

7. The light fixture of claim 6 wherein said fan is mounted within said tubular housing air channel.

8. A light fixture mountable to an overlying structure, the light fixture comprising, a tubular housing having an air inlet and an air channel therethrough, said housing also having an air exit end distal said air inlet defined by a peripherally threaded, annular neck through which said air channel extending;

a mounting plate coupled to said tubular housing, said mounting plate spacing said tubular housing from the overlying structure;

a light diffusor having a central opening therein configured to receive said housing exit end;

a light source positioned between said housing and said light diffusor;

a heat source positioned to heat an airstream passing through said housing air channel, and a locking plate coupled to said neck of said housing exit end, said locking plate having at least one exhaust opening, whereby an airstream passing through the housing is heated by the heat source and expelled from the exhaust opening within the locking plate.

9. The light fixture of claim 8 wherein said locking plate includes an annular array of exhaust openings.

10. The light fixture of claim 8 wherein said heat source is a positive temperature coefficient heater.

11. The light fixture of claim 8 wherein said housing exit end is threaded and said locking plate is threaded to cooperate with said housing exit end.

12. The light fixture of claim 11 wherein said housing exit end has external threads and wherein said locking plate has internal threads.

13. The light fixture of claim 8 further comprising a fan coupled to said housing.

14. The light fixture of claim 13 wherein said fan is mounted within said tubular housing air channel.

15. A light fixture comprising, a tubular housing having an air inlet and an air channel therethrough extending to and through an air outlet, said tubular housing air outlet including a peripherally threaded, annular neck;

a light source coupled to said housing;

a heat source coupled to said housing to heat air passing through said housing air channel;

a locking plate removably coupled to said neck of said housing air outlet, said locking plate having at least one exhaust opening therethrough, and a light diffusor coupleable to said housing;

whereby an airstream passing through the housing is heated by the heat source and expelled from the exhaust opening within the locking plate.

16. The light fixture of claim 15 wherein said locking plate includes an annular array of exhaust openings.

17. The light fixture of claim 15 wherein said heat source is a positive temperature coefficient heater.

18. The light fixture of claim 15 wherein said housing includes a mounting plate having an annular array of air intake openings therein.

19. The light fixture of claim 15 wherein said housing is rotatably coupled to said locking plate.

20. The light fixture of claim 19 wherein said housing and said locking plate are rotatably coupled to each other through corresponding threads.

21. The light fixture of claim 15 further comprising a fan coupled to said housing.

22. The light fixture of claim 21 wherein said fan is mounted within said tubular housing air channel.

* * * * *